US009267756B2

(12) United States Patent
Baks

(10) Patent No.: US 9,267,756 B2
(45) Date of Patent: Feb. 23, 2016

(54) PROJECTILE LAUNCHER

(71) Applicant: Viva Inflatables B.V., Zwolle (NL)

(72) Inventor: Roland Baks, Zwolle (NL)

(73) Assignee: Viva Inflatables B.V., Zwolle (NL)

( * ) Notice: Subject to any disclaimer, the term of this patent is extended or adjusted under 35 U.S.C. 154(b) by 0 days.

(21) Appl. No.: 14/453,590

(22) Filed: Aug. 6, 2014

(65) Prior Publication Data

US 2015/0107568 A1 Apr. 23, 2015

(30) Foreign Application Priority Data

Oct. 22, 2013 (DE) ..... 20 2013 104 753 U
Jan. 9, 2014 (DE) ..... 20 2014 100 077 U

(51) Int. Cl.

| | |
|---|---|
| ***A63G 31/12*** | (2006.01) |
| ***F41A 21/20*** | (2006.01) |
| ***F41B 11/60*** | (2013.01) |
| ***F41B 11/682*** | (2013.01) |
| ***F41B 11/89*** | (2013.01) |

(52) U.S. Cl.

CPC ..... *F41B 11/60* (2013.01); *A63G 31/12* (2013.01); *F41A 21/20* (2013.01); *F41B 11/682* (2013.01); *F41B 11/89* (2013.01)

(58) Field of Classification Search

CPC ..... G07F 17/32; A63F 13/837; A63F 13/211; A63F 13/285; G06T 15/005; F41B 11/00; F41B 11/89; F41B 11/52; F41B 11/53; F41B 11/60; F41B 11/681; F41B 11/721; F41B 11/51; F41B 15/00; F41B 11/85; F41B 11/682; A63B 69/409; A63B 47/002; A63B 5/00; A63B 5/11; A63B 69/40; F42B 6/00; A62C 3/025; A63G 31/12; F41A 21/20

USPC ..... 124/56; 52/2.17; 273/129 AP

See application file for complete search history.

(56) References Cited

U.S. PATENT DOCUMENTS

| | | | | | |
|---|---|---|---|---|---|
| 3,802,705 | A * | 4/1974 | Burns | F41J 11/00 | 124/50 |
| 5,471,797 | A * | 12/1995 | Murphy | A63B 9/00 | 446/220 |
| 5,603,185 | A * | 2/1997 | Murphy | A63B 9/00 | 446/220 |
| 5,678,357 | A * | 10/1997 | Rubio | E04H 15/20 | 40/212 |
| 6,276,353 | B1 * | 8/2001 | Briggs | F41B 11/57 | 124/71 |
| 7,089,703 | B2 * | 8/2006 | Brereton | A63B 9/00 | 472/134 |
| 2008/0223350 | A1 * | 9/2008 | Mahany | F41B 11/68 | 124/56 |
| 2009/0211168 | A1 * | 8/2009 | Bogar | A63G 31/12 | 52/2.17 |
| 2011/0094487 | A1 * | 4/2011 | Woyton | F41B 11/52 | 124/56 |

* cited by examiner

*Primary Examiner* — Troy Chambers
*Assistant Examiner* — Bridget Cochran
(74) *Attorney, Agent, or Firm* — Smartpat PLC

(57) ABSTRACT

An impact-safe projectile launcher for use within an inflatable structure is presented. The projectile launcher comprises a launch tube having an inner end and an outer end. A mount connects the launch tube to the inflatable structure, e.g. a bounce house. An air inlet is provided at the inner end of the launch tube. A projectile inlet is provided downstream of the air inlet at the inner end of the launch tube. An air blower is connected to the inflatable structure and operatively connected such that air flows continuously from the air blower through the air inlet down the launch tube. The continuous flow of air propels impact-safe projectiles that are inserted into the projectile opening down the launch tube and out of the projectile launcher through the outer end of the launch tube.

13 Claims, 4 Drawing Sheets

PROJECTILE LAUNCHER

TECHNICAL FIELD

The present disclosure generally relates to a projectile launcher, and more specifically to an impact safe projectile launcher for use within an inflatable structure.

BACKGROUND

Projectile launchers for propelling impact-safe foam projectiles are generally known and used in participatory play structures. Known projectile launchers include a launch tube sized and configured to accommodate insertion of an impact-safe projectile with substantially little or no friction between the launch tube inner wall and the projectile. A nozzle is disposed at one end of the launch tube. The nozzle receives compressed air and discharges a stream of high-velocity air which impinges upon the projectile within the launch tube. The flow of air into the nozzle is controlled by a play-participant-actuated valve. Upon actuation of the valve the nozzle discharges a stream of high-velocity air which transfers momentum to the projectile, propelling it down the launch tube and into the air or at a selected target. Compressed air is typically supplied by a compressor having an operating pressure of about 40-60 PSI. Projectiles may be inserted into the launch tube through an inlet or a feed tube which intersects the launch tube at the rear end of the projectile launcher.

SUMMARY

An impact-safe projectile launcher for use within an inflatable structure is presented. The projectile launcher comprises a launch tube having an inner end and an outer end. A mount connects the launch tube to the inflatable structure, e.g. a bounce house. An air inlet is provided at the inner end of the launch tube. A projectile inlet is provided downstream of the air inlet at the inner end of the launch tube. An air blower is connected to the inflatable structure and operatively connected such that air flows continuously from the air blower through the air inlet down the launch tube. The continuous flow of air propels impact-safe projectiles that are inserted into the projectile opening down the launch tube and out of the projectile launcher through the outer end of the launch tube.

The mount may be part of the inflatable structure and the air inlet may be an opening between the launch tube and the mount. A single air blower may supply air to the inflatable structure and the projectile launcher. Alternatively, a dedicated air blower may supply air to the launch tube or to the launch tube and the mount. A second air blower may then be used to supply air to the inflatable structure. In that case the dedicated air blower may be connected to the air inlet by an air duct which extends through and is sealed against the inflatable structure. This air duct may be a tube or a hose made of a flexible material.

The projectile launcher may be removably connected to the inflatable structure by a hook and loop fastener or by a zipper. The projectile launcher may be made of inflatable fabric.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

Figure 1:
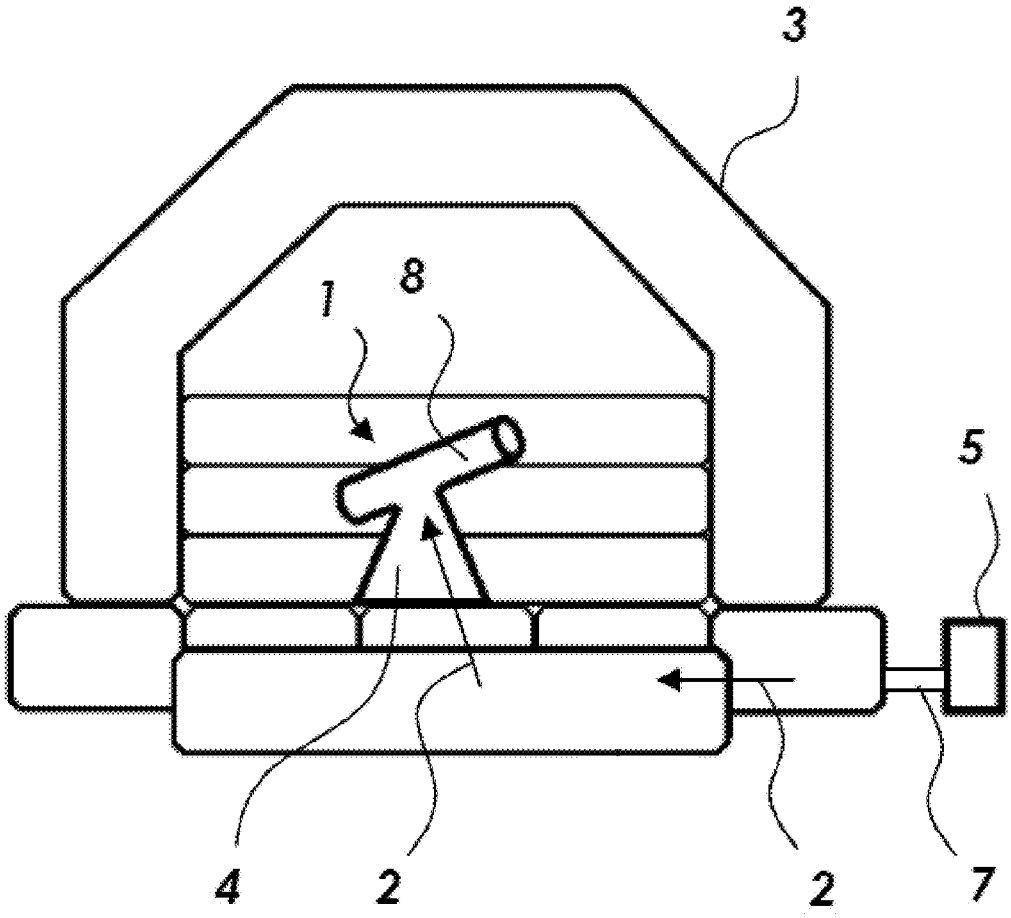
FIG. 1 shows an exemplary inflatable structure with a projectile launcher, the inflatable structure and the projectile launcher being supplied by a common air blower.

Referring to FIG. 1, a projectile launcher 1 is provided within an inflatable structure 3. The inflatable structure 3 may for example be an inflatable bounce house which is a popular entertainment device especially for children. The inflatable structure is operatively connected to and inflated by an air blower 5. The air blower 5 continuously blows air into the inflatable structure 3, compensating for any leaks in the inflatable structure 3 and guaranteeing positive air pressure within the walls of the inflatable structure 3, thus preventing the inflatable structure 3 from collapsing.

Figure 3:
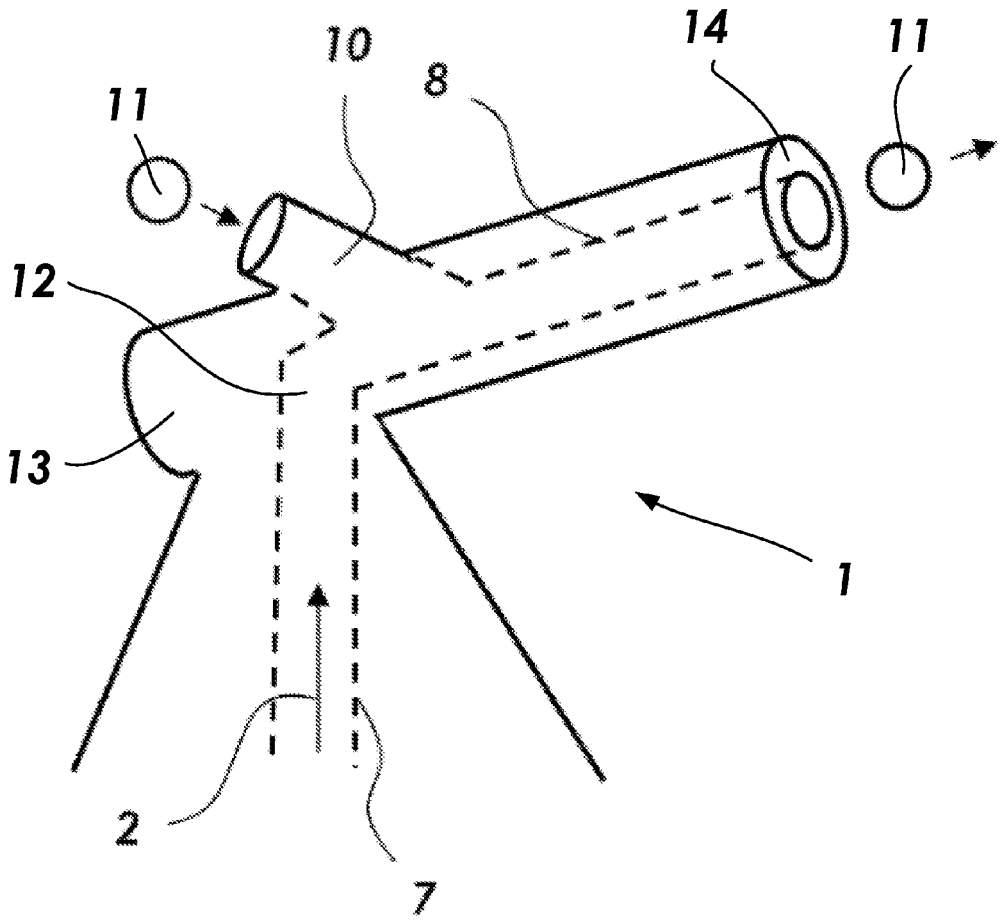
FIG. 3 shows an exemplary projectile launcher and projectiles.

As shown in FIG. 3, the projectile launcher 1 comprises a launch tube 8 which is disposed on top of a mount 4 that connects the launch tube 8 to the inflatable structure 3. The launch tube 8 extends from an inner end 13 to an outer end 14. An air inlet 12 is provided at the inner end 13 of the launch tube 8. A projectile inlet 10 is provided downstream of the air inlet 12 at the inner end 13 of the launch tube 8.

In use, air 2 continuously flows from an air duct 7 into the launch tube 8 through the air inlet 12. The air 2 continues to flow though the launch tube 8 and out of the open outer end 14 of the launch tube 8. Soft, impact-safe projectiles 11 may be inserted into the launch tube 8 through the projectile inlet 10. The continuous flow of air 2 through the launch tube 8 accelerates these projectiles 11 and propels them out of the outer end 14 of the launch tube 8.

Figure 2:
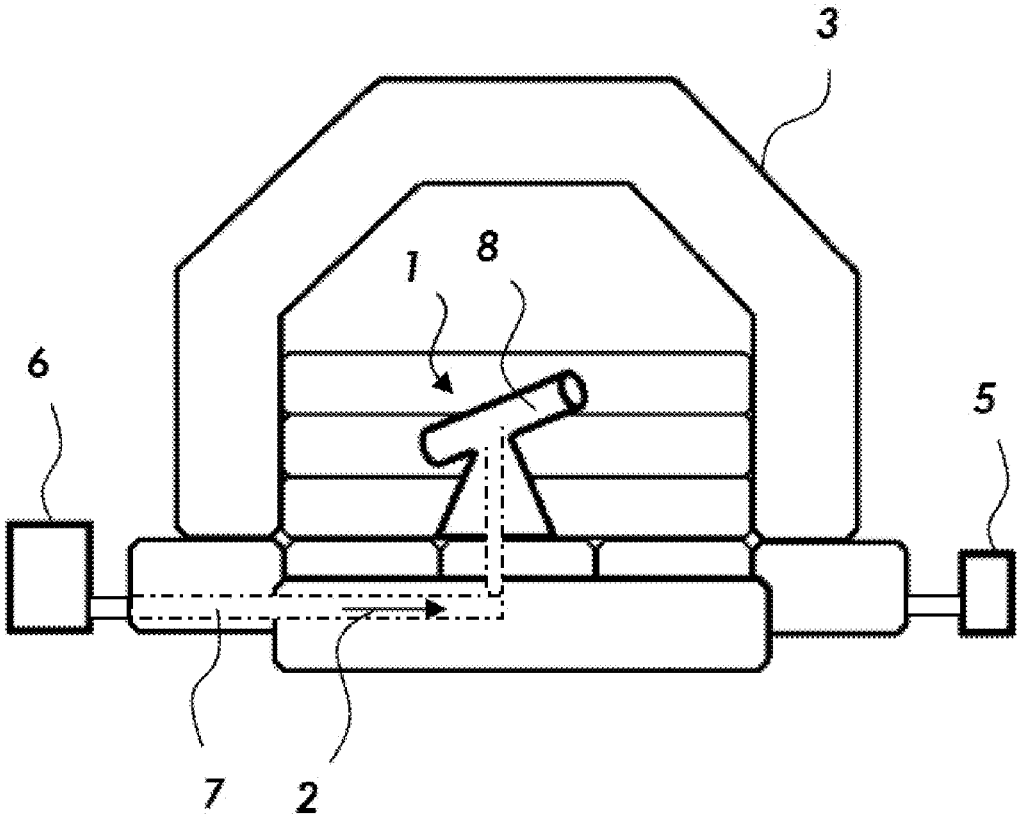
FIG. 2 shows an exemplary inflatable structure with a projectile launcher, the projectile launcher being supplied by a dedicated air blower.

As shown in FIG. 1, the mount 4 and/or the launch tube 8 may be made of inflatable textile material and inflated jointly with the inflatable structure 3 by the air blower 5. The air inlet 12 may be a simple opening from the mount 4 to the inside of the launch tube 8. As shown in FIG. 2, the projectile launcher 1 may alternatively be connected to a dedicated air blower 6, which is independent from a second air blower 5 that supplies the inflatable structure 3. In this case, the dedicated air blower 6 is connected to the projectile launcher 1 by an air duct 7. Air duct 7 runs through the inflatable structure 3 and is sealed against the inflatable structure 3. The dedicated air blower 6 may supply air exclusively to the launch tube 8 while the mount 4 is inflated by the second air blower 5. In that case the air duct 7 extends from the dedicated air blower 6 to the air inlet 12 without any other openings. Alternatively, the dedicated air blower 6 may supply air to both the mount 4 and to the launch tube 8.

The projectile launcher 1 may be made of hard material such as metal, wood or plastic. The projectile launcher 1 may alternatively be made of inflatable air impervious material such as resin infused cloth or PVC coated polyester reinforced fabric. The projectile launcher 1 may be made of multiple pieces of inflatable air impervious material that are sawn together. The air duct 7 may be a tube or a hose made of flexible material such as PVC, plastic, rubber or the like. The air duct 7 may be made of the same material as walls of the inflatable structure 3.

The projectile launcher 1 may be removably attached to the inflatable structure 3, for example by a hook and loop attachment or by a zipper. If the projectile launcher 1 is inflated jointly with the inflatable structure 3 a cover may be attached to the inflatable structure 3 instead of the projectile launcher 1 when the projectile launcher 1 is not used. Also, the projectile launcher 1 may be added to an existing inflatable structure 3 as part of a retrofit.

Figure 4:
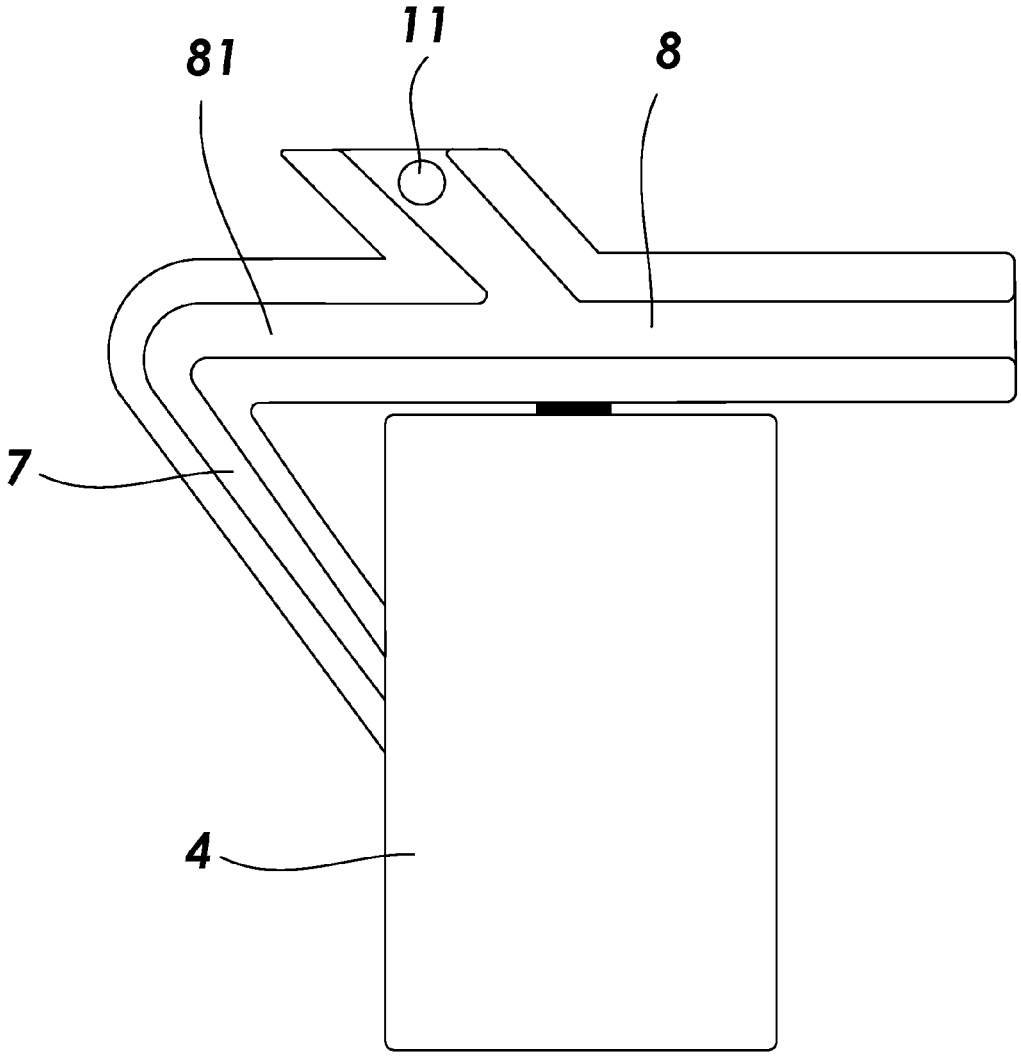
FIG. 4 is a cross sectional view through an exemplary projectile launcher having an exterior air supply to the launch tube.

As shown in FIG. 4, air duct 7 may be formed as an exterior duct, hose or pipe and may be flexible or rigid. An outlet end of the air duct 7 connects to the inner end 81 of the launch tube 8 exterior of mount 4. The inner end 81 of the launch tube 8 is open and thus provides an air inlet to the launch tube 8. The opposite inlet end of air duct 7 connect to an air supply, for example to the inflated mount 4. The inlet end of the air duct 7 may alternatively connect directly to an air blower or to the inflatable structure. The inlet end of the air duct 7 may in particular be connected to a dedicated air blower which supplies air only to the projectile launcher, and is not connected to the inflatable structure.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. A projectile launcher, comprising: a launch tube having an inner end and an outer end; a mount connecting the launch tube to an inflatable structure; an air inlet provided at the inner end of the launch tube; a projectile inlet provided downstream of the air inlet at the inner end of the launch tube; and an air blower connected to the inflatable structure, wherein air flows continuously from the air blower through the air inlet down the launch tube and propels impact-safe projectiles that are inserted into the projectile inlet of the launch tube through the outer end of the launch tube.

2. The projectile launcher as in claim 1, wherein the mount is a part of the inflatable structure and the air inlet is an opening between the launch tube and the mount.

3. The projectile launcher as in claim 2, wherein the air blower supplies air to the inflatable structure and the projectile launcher.

4. The projectile launcher as in claim 1, wherein the air blower is connected to the air inlet by an air duct which extends through and is sealed against the inflatable structure.

5. The projectile launcher as in claim 4, wherein the air blower supplies air only to the projectile launcher.

6. The projectile launcher as in claim 4, wherein the air duct is a tube or a hose made of a flexible material.

7. The projectile launcher as in claim 1, wherein the projectile launcher is removably connected to the inflatable structure by a hook and loop fastener or a zipper.

8. The projectile launcher as in claim 1, wherein the inflatable structure is a bounce house.

9. The projectile launcher as in claim 1, wherein the launch tube is made of inflatable fabric.

10. A projectile launcher, comprising: a launch tube having an inner end and an outer end; a mount connecting the launch tube to an inflatable structure; an air duct having an inlet end and an outlet end, the inlet end of the air duct being connected to an air supply and the outlet end of the air duct being connected to the inner end of the launch tube; a projectile inlet provided downstream of the outlet end of the air duct at the inner end of the launch tube; and a first air blower connected to the inflatable structure, wherein air flows continuously from the air supply through the air duct and further down the launch tube and propels impact-safe projectiles that are inserted into the projectile inlet of the launch tube through the outer end of the launch tube.

11. The projectile launcher as in claim 10, wherein the inlet end of the air duct is connected to the inflatable structure.

12. The projectile launcher as in claim 10, wherein the inlet end of the air duct is connected to a second air blower.

13. The projectile launcher as in claim 10, wherein the air duct is exterior of the mount and the inflatable structure.

* * * * *